United States Patent [19]

Reeve et al.

[11] Patent Number: 4,599,975

[45] Date of Patent: Jul. 15, 1986

[54] CONTROL OF BOILER OPERATIONS

[75] Inventors: Douglas W. Reeve; Hoc N. Tran, both of Toronto, Canada

[73] Assignee: 471199 Ontario Limited, Toronto, Canada

[21] Appl. No.: 646,016

[22] Filed: Aug. 31, 1984

[30] Foreign Application Priority Data

Sep. 1, 1983 [GB] United Kingdom ..... 8323409

[51] Int. Cl.[4] ..... F22B 37/18; F22B 37/48

[52] U.S. Cl. ..... 122/379; 122/382; 122/390; 122/392; 165/95

[58] Field of Search ..... 122/379, 390, 392, 382; 236/15 BB, 15 E; 431/76; 165/95

[56] References Cited

U.S. PATENT DOCUMENTS 3,257,993 6/1966 Koehey, Jr. ..... 122/392
3,276,437 10/1966 Jonakin et al. ..... 122/392
4,408,568 10/1983 Wynnyckyj et al. ..... 122/379
4,475,482 10/1984 Moss et al. ..... 122/379
4,488,516 12/1984 Bueters et al. ..... 122/379

*Primary Examiner*—Edward G. Favors
*Attorney, Agent, or Firm*—Sim & McBurney

[57] ABSTRACT

A deposit measuring device, useful for improving combustion processes especially kraft mill recovery boilers, determines the temperature at the windward and leeward sides of a probe tube positioned in the flue gas stream transverse thereto and then determines the rate of build-up of deposits on at least the windward side and the temperature of the flue gas stream. This information is used by an operator or automatically to control boiler operations. The measuring device has a deposit removal means associated therewith periodically to remove deposits from the tube. The ability to control the boiler operation enables considerable economic benefits to be achieved.

28 Claims, 5 Drawing Figures

CONTROL OF BOILER OPERATIONS

FIELD OF INVENTION

The present invention relates to improving the operation of boilers, especially kraft pulp mill recovery boilers.

BACKGROUND TO THE INVENTION

The occurrence of fireside deposits on heat transfer surfaces in industrial and utility boilers is a persistent problem. The deposits often cause serious loss of heat transfer efficiency, increased corrosion of superheater and boiler tube metals, high operating costs for deposit removal, and plugging of flue gas passages.

These problems are particularly severe in the kraft pulping chemical recovery boiler because of the high ash content (about 35 to 45%) of the fuel, the black liquor comprising spent pulping chemicals from the pulping operation, possibly combined with some bleach plant effluent, and the highly volatile nature of the ash. It has been estimated that about 10 to 20% of the total ash introduced with the black liquor ends up as either carryover particles or fume dust engrained in flue gases. As a result, massive accumulation of deposits from the flue gas on the heat transfer surfaces is not an uncommon occurrence in kraft recovery units, often leading to a complete blockage of the boiler, causing significant production losses associated with unscheduled shutdowns.

Kraft recovery unit deposits consist mainly of sodium sulphate, sodium carbonate, sodium chloride, with a small amount of sodium hydroxide, potassium salts and reduced sulphur compounds. The deposits are formed by two distinctly different mechanisms, namely impaction of carryover particles on heat transfer surfaces (carryover) and deposition by condensed vapours of compounds volatilized in the lower part of the unit (condensation). In the lower superheater region, particularly on the windward side of the tubes, the carryover mechanism is dominant, forming hard and thick deposits. In the upper superheater region, generating section and economizer, deposits are formed mainly by condensation and, under normal conditions tend to be white, friable, powdery and relatively easy to remove.

To prevent the adverse effects of massive deposit accumulation noted above, deposit control is critical to the efficiency and availability of the recovery unit. Deposit accumulation conventionally is controlled in two ways, namely removal of deposits by sootblowers and optimization of the firing conditions in the lower furnace to prevent massive deposit build-up.

To achieve removal of deposit accumulation, sootblowers inject high pressure steam through small rotating nozzles to dislodge deposits from heat transfer surfaces. Sootblowers are operated on various cleaning energy level and blowing frequencies, depending on the location, boiler operating conditions and nature of deposits. Draft loss across the superheater, boiler bank and economizer, and/or flue gas temperatures at the boiler bank and economizer outlets are used as guidance for sootblower operation. A higher blowing frequency normally is required in the generating and economizer sections than in the superheater region, since the flue gas passages in the generating and economizer sections are much narrower and more susceptible to blockage than in the superheater region and, in the superheater region, the gas temperature is high and the deposit melts and ceases growing after building up to a certain thickness.

Acoustic devices or sonic sootblowers, employing low frequency sonic and high power waves, also have been used to remove powdery deposits and dust in the economizer and areas where dry dust prevails. Such devices also may be employed in locations, such as connecting ducts, choppers and precipitators, where steam lances would not be appropriate.

Both steam and sonic sootblowers are generally quite effective in the removal of friable and powdery condensation deposits but are not effective against the hard and tenacous carryover deposits, particularly when there are molten phases involved.

In units experiencing serious plugging problems, the control of massive deposit accumulation by additives in addition to sootblowers has been sometimes attempted. Such additives are believed to modify deposit chemistry, decrease deposit stickiness and tenacity, and improve the deposit removal efficiency of sootblowers. The results of the use of such additives, however, have not been conclusive.

The major difficulty encountered in the deposit control strategy is the absence of effective means for deposit monitoring. The control of deposit accumulations has largely been based on the experience of the individual operators, with the crude information provided indirectly by the measurement of pressure drop or draft loss across the superheater, boiler bank and economizer. When the pressure drop becomes abnormally high, it often is too late to take any preventative action, since most of the flue gas passages will already be blocked and the deposits will have become resistant to sootblowing.

In most recovery units, the deposit accumulation is crudely followed by the operator by monitoring the change in flue gas temperatures at the boiler bank and economizer outlets. At a given black liquor firing rate, higher flue gas temperatures imply more deposit accumulation since less heat has been transferred from flue gas to steam. The flue gas temperature, however, is also significantly influenced by many other operating factors and hence may not be relied upon entirely to indicate the degree of deposit accumulation in the unit.

Further, since plugging and superheater corrosion usually occurs in the superheater and generating sections, the continuous measurement of the flue gas temperature in the superheater region and boiler bank inlet is important and critical to the deposit control strategy. However, as a result of the highly corrosive and dirty environment in these regions, no means of continuous flue gas temperature measurement is presently available.

More recently, computer control systems have been developed to optimize sootblowing and boiler operation. Deposit accumulation is monitored by draft loss, gas temperature drop or heat transfer into the water in the economizer or into the steam in the superheater. However, all these measurements give only crude indications of deposit accumulation, particularly in the case of large boilers.

Optical devices, such as dust sensors, opacity meters and smoke meters, have been used to monitor and control dust and particulate emission. These devices, however, can only to be used at locations after the electrostatic precipitator where the duct is narrow and both dust concentrations and flue gas temperature are low.

As noted above, the prevention or control of deposit accumulation by manipulating boiler operating conditions is universally practised, based on the operator's own experience. Massive deposit accumulation would appear to be caused by a number of variables related to boiler operation, boiler design and deposit control and removal. The variables often interact with one another, with the result that a change in one operating variable can easily affect the others in both constructive and destructive ways, making it difficult to identify the cause of massive deposit buildup.

Resulting from the lack of effective deposit-monitoring devices and scientific guidelines, the prevention of massive deposit accumulation by optimizing firing conditions in the lower furnace has been carried out on a "trial-and-error" basis and has not achieved much success, particularly for units which are overloaded.

Utility and industrial boilers, including coal and oil-fired boilers, and municipal and industrial waste incinerators, also experience problems associated with fireside deposits, particularly decreases in heat transfer efficiency and high temperature corrosion. Plugging problems in these boilers is not the major concern it is in kraft recovery units, because of the much lower ash content of the fuels. The deposits formed in such boilers are usually heavier, hardier and melt at much higher temperatures than kraft recovery unit deposits. In contrast with kraft recovery unit deposits which consist mainly of water-soluble sodium salts, deposits in coal-fired boilers are insoluble, consisting of high proportions of silica, alumina, iron oxides, calcium oxides and sulphate with only a small amount of water-soluble alkali salts. Deposits in oil-fired boilers are similar but also can contain relatively high concentrations of vanadium compounds.

The control of deposits in utility boilers is carried out in much the same way as in kraft recovery units by using sootblowers to dislodge deposits and draft loss and/or flue gas temperature determinations for deposit monitoring. As in kraft recovery units, there is presently no effective means of monitoring deposit accumulation in utility and industrial boilers.

In U.S. Pat. No. 4,408,568 to Wynnyckyj et al, there is described a furnace wall deposit monitoring system using two radiant type heat flux probes, one clean and one fouled by deposits. Although this system can be operated as an on-line instrument to monitor deposit accumulation on the furnace wall, the system cannot be employed to monitor carryover deposits since the heat flux probes are mounted on the furnace wall which is parallel to the flow direction of the flue gas.

As may be seen from the above discussion of the state of the art, there is no direct means of measuring deposit accumulation, so that an operator is not aware of how much carryover there is in the upper part of his boiler at a particular time. This information is particularly important in the kraft recovery unit, since short term variations in the boiler operation can have a dramatic effect on boiler plugging and episodes of high carryover and/or high temperature can quickly plug a boiler.

Accordingly, there is a need for advance deposit control, particularly for kraft mill recovery units, to lower sootblower steam requirements, decrease forced shutdown for recovery unit washouts, improve recovery unit thermal efficiency and increase recovery unit capacity and thereby pulp production capacity.

SUMMARY OF INVENTION

In accordance with one aspect of the present invention, there is provided a deposit monitoring device for use in connection with deposit control in kraft recovery and other boiler units. The device of the invention is capable of providing reliable and representative signals corresponding to the accumulation rate of deposits on a continuous basis, is simple in design and is easy to install, operate and maintain, and has corrosion resistance and high mechanical strength to withstand the rigorous environment of the boiler.

Accordingly, the present invention provides a deposit monitoring device for contct with a hot flowing gas stream, which comprises elongate probe arm means adapted to be located in contact with the gas stream to establish a windward and a leeward side of the probe arm means with respect to the flowing gas stream, first heat detection means associated with the windward side of the probe arm means for detection of heat reaching the windward side of the probe arm means from the gas stream, and second heat detection means associated with the leeward side of the probe arm means for detection of heat reaching the leeward side of the probe arm means from the gas stream.

With the device extending in contact with the flowing gas stream transverse to the direction of flow, carryover particles impact on the windward side of the probe arm and form a deposit thereon, while condensation deposition may form a deposit on the leeward side. As the thickness of deposit grows on the windward side of the probe arm, the surface temperature decreases corresponding to the heat transfer rate due to insulation resulting from the accumulation of deposits.

In gas streams where leeward side deposition does not occur or is minimal, the deposit accumulation rate on the probe arm is determined by measuring the difference between the windward and leeward surface temperatures, usually by using appropriately-located thermocouples attached to the internal walls of a hollow metal probe arm, since the leeward side is relatively clean and may be used as a reference. Since the absolute temperature of both the windward and leeward surfaces varies with fluctuations in flue gas temperature, the influence of flue gas temperature variation is minimized by measuring the difference between the windward and leeward surface temperatures. In addition, since, in this embodiment, the leeward side of the probe arm is covered at most with a thin layer of deposit and hence the surface temperature varies consistently with flue gas temperature, once the relationship between the leeward side surface temperature and the flue gas temperature is established empirically, the flue gas temperature in the area adjacent to the probe arm can easily be determined.

For gas streams where leeward side deposition occurs over time, a further heat detection means, typically a thermocouple, is provided and maintained free from deposits. The deposit accumulation rate on the windward side of the probe arm is determined by measuring the difference between the surface temperature of the windward side and the temperature of the deposit-free thermocouple while the deposit accumulation rate on the leeward side of the probe arm is determined by measuring the difference between the surface temperature of the leeward side and the temperature of the deposit-free thermocouple.

The physical condition of the deposits formed on the probe arm, i.e. whether completely solidified or partially molten, may be determined by providing electrical conductivity determining means in association with the probe arm. The deposition sites on the probe arm usually are periodically cleaned, so that signals over short periods may be determined and short term changes in combustion conditions detected.

The measurements made with the monitoring device of the invention represent the condition of the flue gas stream at the location of the monitoring device. By providing a monitoring device adjacent one or more of the banks of heat exchanger surfaces in the heat recovery section of the boiler unit, the rate of build-up of deposits on the heat exchanger surfaces, fluctuations in flue gas temperature and the physical condition of the deposits may be determined. The information is generated by the monitoring device continuously and may be utilized, by an operator or automatically, to vary the operating conditions of the furnace and/or to activate sootblower operation.

In another aspect of the present invention, therefore, there is provided a control method for a combustion operation wherein combustible material is burned to form a hot gaseous product stream from which heat is recovered by contact with heat exchanger surfaces and from which solid material is deposited onto the heat exchanger surfaces, which comprises locating a deposit surface in the gaseous product stream adjacent the heat exchanger surfaces, detecting the rate of build-up of deposits on the deposit surface as a function of rate of build-up of deposits on the heat exchanger surfaces, and controlling the combustion conditions to control the rate of build-up of deposits on the heat exchanger surfaces in response to the detected build-up of deposits on the deposit surface.

By the utilization of the monitoring device and method of the present invention for effective continuous monitoring and process control, the potential for massive deposit build-up and perhaps shut-down is minimized or even eliminated. By effectively monitoring the rate of deposit formation, the timely and efficient use of sootblowers may be activated, leading to lower sootblower steam requirements and improved recovery unit thermal efficiency. Since the rate of deposit formation is determined on-line and continuously by the device of the invention the capacity of the combustion unit may be increased.

DESCRIPTION OF PREFERRED EMBODIMENTS

Figure 1:
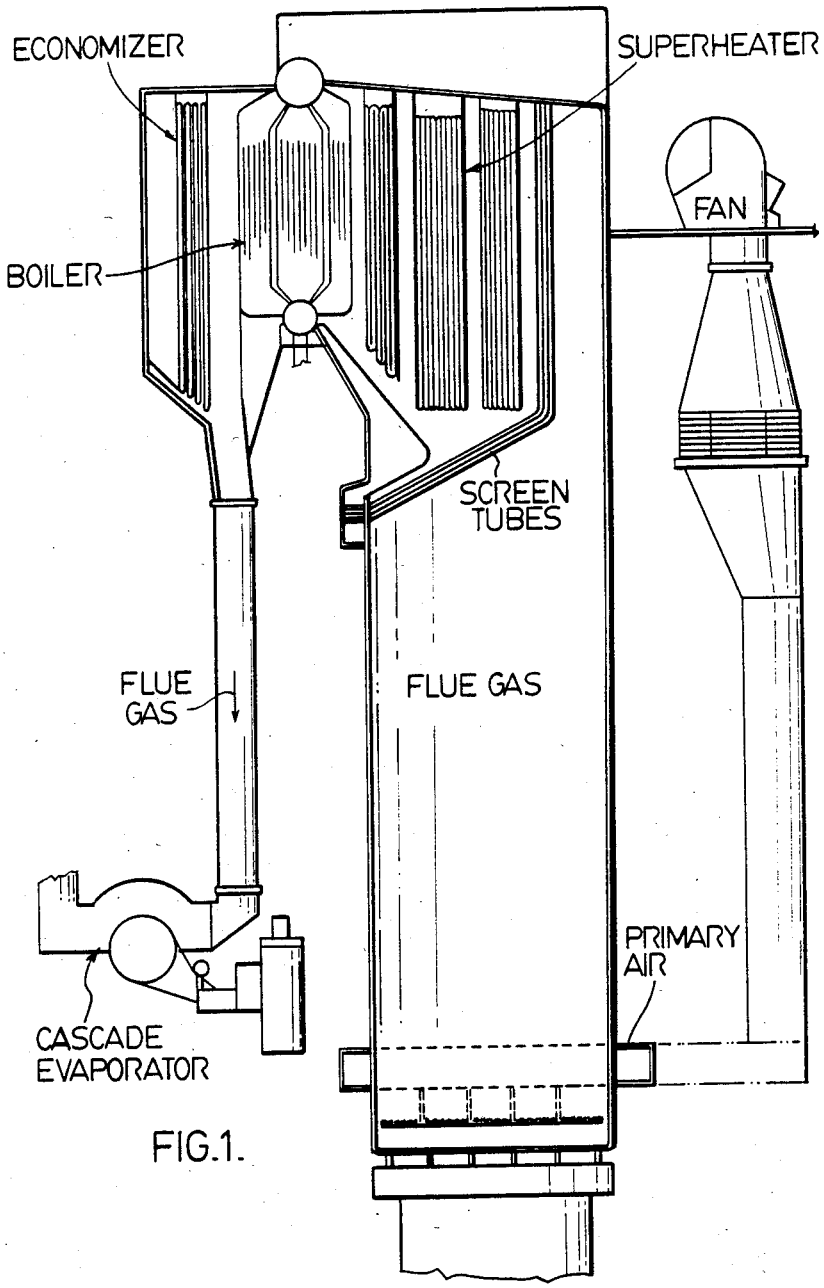
FIG. 1 is a schematic representation of a kraft pulp mill recovery furnace illustrating the locations of deposit monitoring devices constructed in accordance with the invention.

Referring to the drawings, FIG. 1 is a schematic representation of a typical kraft pulp mill black liquor boiler in which spent pulping liquor is combusted in air to form smelt containing recovered pulping chemicals for further processing and recycle and a flue gas stream. The significant features of the boiler are labelled thereon. As may be seen from FIG. 1, the hot flue gas stream passes successively in contact with a plurality of banks of heat exchanger surfaces for the removal of heat from the flue gas stream, including a superheater, boiler and economizer.

Deposit measuring devices may be provided, in accordance with this invention, at convenient locations in association with the heat exchanger surfaces. As illustrated in FIG. 1, deposit mesuring devices are positioned in the lower superheater and in the boiler bank inlet. The use of the two such devices is one embodiment of the invention and from two to four deposit measuring devices installed in the superheater region and boiler bank inlet normally should be sufficient to provide the optimum measurements to achieve complete control of the boiler operation.

Figure 2:
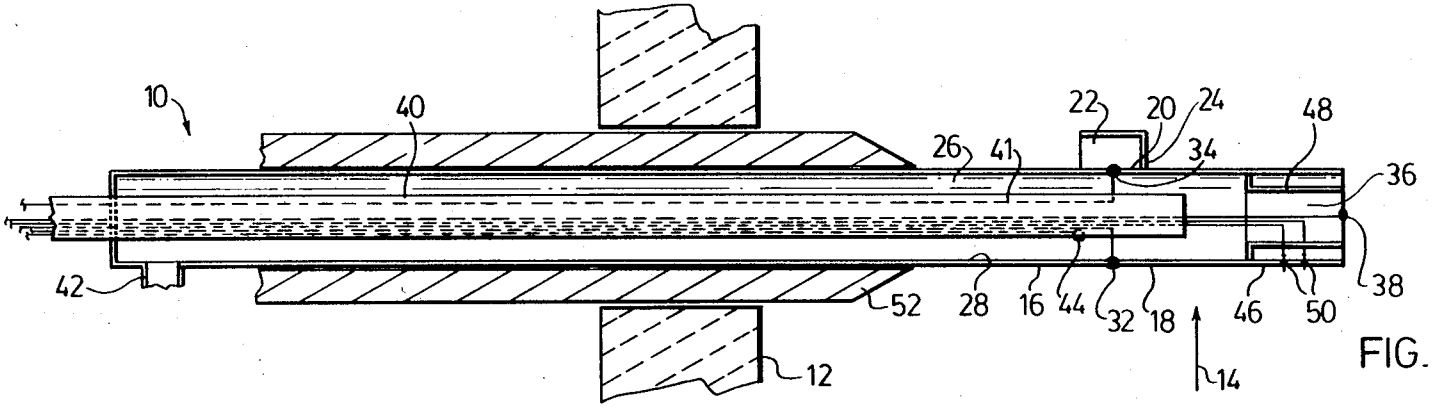
FIG. 2 is a schematic representation of a deposit monitoring device constructed in accordance with one embodiment of the present invention.

FIG. 2 illustrates schematically a deposit measuring device constructed in accordance with one embodiment of the invention. As seen therein, a deposit measuring device or probe 10 in the form of an elongate tube extends through a furnace wall 12 of a kraft pulp mill black liquor recovery unit such as is illustrated schematically in FIG. 1, transverse to the path of an upwardly-flowing flue gas stream 14, which contains entrained depositable solids resulting from combustion of the black liquor.

The outer surface 16 of the probe 10 within the furnace has a windward side 18 located facing the upflowing flue gas stream 14 and a leeward side 20 located on the opposite side of the probe surface 16 from the windward side 18. The leeward side 20 may take the form of a chamber 22 having an outer housing 24 to afford protection from deposition of carryover solids thereon.

Deposits form on the windward side 18 by impact thereof from the flue gas stream 14 onto the probe surface 16. Solids are collected on the leeward side 20 by condensation of condensible vapours in the flue gas stream 14.

As noted above, the probe 10 takes the form of an elongate hollow tube preferably constructed of rigid heat-conductive material, such as stainless steel, and has an axial passage 26 extending therethrough. Located on the internal surface 28 of the probe 10 at the deposition sites on the windward and leeward sides of the probe 10 are thermocouples 32 and 34, or other heat-sensing signal-producing means, such as, a heat flux sensor. Thermocouples sense the heat reaching the internal surface 28 at each deposition site through any deposits formed on the windward and/or leeward side.

The hollow interior 26 of the probe 10 has a narrower diameter portion 36 adjacent an outlet thereof. A thermocouple 38, or other heat-sensing signal-producing means, such as, a heat flux sensor, is located in the outlet to the narrower diameter portion 36, and is a reference thermocouple with respect to the thermocouples 32 and 34 and compensates for variations in temperature of the flue gas stream 14.

A tube 40 is positioned within the interior of the probe 10 to house connecting wires 41 for the various sensors and to create turbulence to enhance internal cooling. An air flow inlet 42 communicates with any convenient source of compressed air, so that air flows within the interior 26 of the probe 10 and continuously over the thermocouple 38, as the air exits to the flue gas stream 14, to prevent the formation of deposits thereon. A further thermocouple 44 is attached to the outer surface of the support tube 40 to enable the temperature of the air flowing in the hollow interior 26 of the probe 10 to be sensed and appropriate adjustment to be made should the air temperature vary from a predetermined value.

The probe 10 includes a cylindrical extension 46 which surrounds the decreased diameter portion 36 and defines an annular gap 48 therebetween. A pair of conductivity electrodes 50 are located protruding through the extension 46 from the annular gap 48 to the outer surface.

The provision of the windward and leeward deposition sites 18 and 20 enables the occurrence of the two types of depositable material in the combustion gas stream 14 to be monitored independently. As the deposits form on the windward and leeward deposition sites 18 and 20, the heat reaching the thermocouples 32 and 34 respectively from the flue gas stream declines as a result of the insulating effect of the solids. The rate of buildup or accumulation of deposits on the windward side 18 is determined by comparing the heat sensed by thermocouple 32 with the heat sensed by the clean thermocouple 38 while the rate of build-up of deposits on the leeward side 20 is determined by comparing the heat sensed by thermocouple 34 with the heat sensed by the clean thermocouple 38.

The determinations of the rate of build-up of deposits on the windward side and leeward side of the tubular probe 10 are indicative of the rate of build-up of deposits on the heat exchanger tubes located adjacent the probe 10 in the heat recovery section of the boiler unit and may be used herein to effect control over the rate of build-up on the heat exchanger tubes and/or to activate sootblower operation to clean the heat exchanger tubes.

Depending on the rate of build-up of deposits on the outer surface of the probe 10, the firing conditions of the boiler unit may be adjusted to minimize carryover or the bed conditions of the combustion unit may be adjusted to minimize vaporization, as appropriate. These adjustments in operating conditions may be made by an operator in response to a read-out or display of the above-noted determination or automatically in response to computerized processing of the generated signals.

The use of temperature measurement corresponding to the loss of heat transfer rate on accumulation of deposit, as described above, is only one way in which the rate of deposit accumulation may be measured to provide signals for boiler unit control. Other procedures include mechanical measurement and heat transfer measurement to maintain a given temperature in the face of accumulation of deposit.

Surrounding the probe 10 is an axially-movable scraper 52 which is periodically activated to remove accumulations from the windward and leeward sides 18 and 20. Other methods of deposit removal include other mechanical removal procedures, melting, air blowing or steam blowing. By effecting such periodic deposits removal on a short interval basis, the rate of deposition of solids over short periods of time, typically on a scale of hours, can be determined.

The ability of operate in this manner is significant, in that short term variations in recovery boiler operations can have a dramatic effect on heat exchanger tube plugging. As noted earlier, periods of high carryover and/or high temperature can rapidly plug a bank of heat exchanger tubes normally relatively free from deposits.

The conductivity electrodes 50 exposed to the flue gas stream 14 serve to measure the physical state of the deposit formed on the windward side 16 in situ. The deposits which form on the outer surface of the probe 10 have a variable electrical conductivity, depending on molten material content, and the proportion of molten material can be determined from the magnitude of the current passing between the electrodes 50. As the furnace gas temperatures increase, the proportion of molten material also increases.

The in-situ measurement of the physical state of the deposit determines the deposit condition on the surface of the probe 10 and hence on the adjacent heat exchanger surfaces at the prevailing flue gas temperature. This determination may be used to avoid the occurrence of sticky or slagging deposits at critical locations in the combustion unit, particularly entering the boiler bank, or in the case of pyrosulfate deposits, in the economizer region, by controlling the flue gas temperature.

The flue gas temperature of the boiler unit may be controlled to just below that which causes formation of sticky or slagging deposits at undesired locations in the boiler. Such flue gas temperature control may be made by an operator in response to a read-out or display, or may be carried out automatically in response to sensed conditions, as desired. By controlling the boiler gas temperature in this way, so as to avoid unwanted depositions within critical regions of the recovery unit, the load on the combustion operation may be increased with confidence.

The use of electrical conductivity as a measure of the physical conditions of the deposit, as described above, represents but one way in which this measurement may be effected. Other convenient procedures include differential thermal analysis.

As may be noted from the above description of the embodiment of FIG. 2, the probe 10 is able to determine the rates of build-up of different types of deposits on both the windward and leeward sides of the probe by comparing temperatures sensed at the respective surfaces of the probe 10 with a reference temperature. It has been found that the depositable-material content of the flue gas stream may be such that the build-up of deposits occurs on the windward side of the probe, while little or no deposition occurs on the leeward side. Where deposition occurs on the leeward side under these circumstances, a thin deposit is formed which does not grow significantly in thickness compared to the windward side, and hence the temperature of the leeward side may be employed as the reference temperature for the determination of the rate of build-up on the windward side. A probe 110 of this type is illustrated in FIG. 3, which represents the current best mode known to the applicants.

Figure 3:
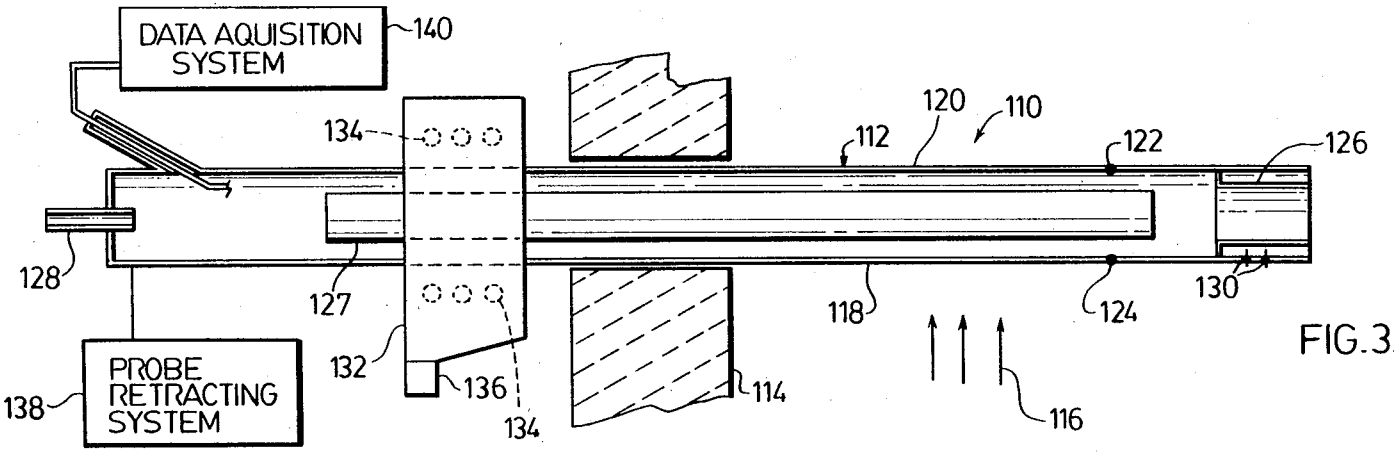
FIG. 3 is a schematic representation of a deposit monitoring device constructed in accordance with another embodiment of the invention.

Referring to FIG. 3, a deposit monitoring device 110 comprises an elongate hollow tubular probe arm or rod 112 constructed of corrosion-resistant heat-conductive material which projects through a furnace wall 114 of a combustion unit at a convenient location transversely to an upwardly-flowing flue gas stream 116 to establish a windward side 118 and a leeward side 120 of the tube. Thermocouples 122 and 124 are attached to the internal surface of the tube 112 to sense the heat reaching both the windward and the leeward sides 118 and 120 respectively. An air outlet tube 126 is provided to permit air fed to the tube 112 through inlet 128 to exit the tube 112 into the flue gas stream. The air outlet tube 126 is of lesser diameter than the tube 112 so as to maximize the cooling air efficiency by increasing turbulence. In addition, a rod 127 is located coaxially with the tube 112 also to increase turbulence and cooling efficiency. The air flow acts to cool the tube 112 to prevent heat deformation or degradation. Electrodes 130 are positioned in the outer surface of the tube 112 on the windward side 118.

A washing chamber 132 is provided surrounding the tube 112 and is provided with hot water jets 134 for spraying hot water onto the outer surface of the tube 112 to remove deposits from the surface with spent water passing from the washing chamber by drain 136. A probe retracting mechanism 138 is provided in association with the device 110 for periodically retracting the tube 112 at preset time intervals from contact with the flue gas stream and through the washing chamber 132 for the removal of deposits therefrom. A data acquisition system 140 is provided for receiving signals from the thermocouples 122 and 124 and the electrodes 130, for processing the signals and for providing a visual display of deposit accumulation rate and flue gas temperature.

While in contact with the glue gas stream 116, deposits form on the tube 112. On the leeward side 120 a thin deposit only is formed which does not grow in thickness, while, on the windward side 118, the deposit grows in thickness with time. The leeward side 120 is effectively a reference, so that a comparison of the heat detected by the thermocouple 124 with that detected by the thermocouple provides a measure of the rate of deposition of deposits on the windward side 118. The measure of the temperature at the leeward side 120 by the thermocouple 122 may also be used to detect variations in absolute temperature of the flue gas stream 116. The data may be displayed for use by the operator in controlling the furnace or may be used for automatic control of furnace operation. The electrodes 130 detect the electrical conductivity of the deposit, so as to ascertain its physical form.

Figure 4:
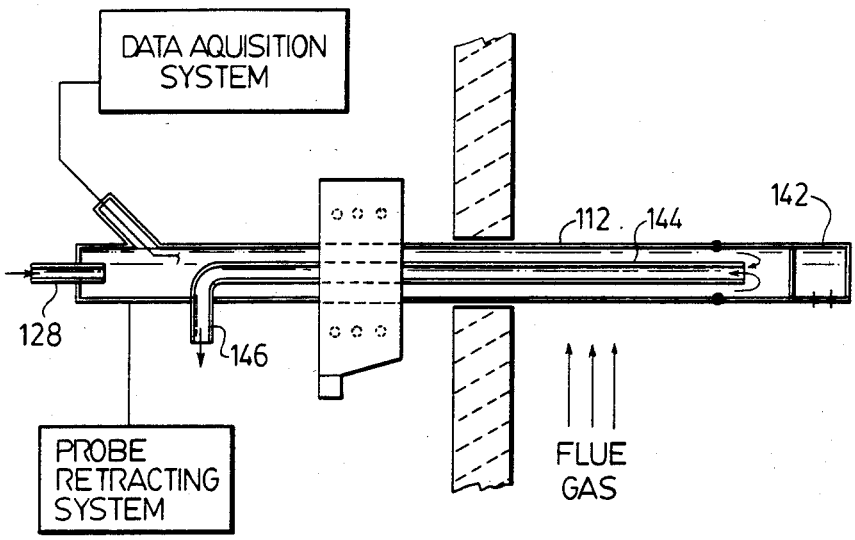
FIG. 4 is a schematic representation of a modified form of the deposit monitoring device of FIG. 3.

In the modified structure of FIG. 4 elements in common with FIG. 3 have been commonly numbered, the hot end 146 of the probe tube 112 is closed, an inner tube 144 is provided and a gaseous outlet 146 is provided adjacent the inlet 128. This modification may be employed in installations where further external introduction of air is not desired. The cooling air passes along the outer side of the inner tube 144, U-turns at the tip 142 and flows through the inner tube 144 to the outlet 146.

The deposit monitoring devices or probes illustrated in FIGS. 2 to 4 are fully automated, are simple in operation and require minimum supervision. The probe exposure time may be varied over a wide range, typically from 1 to 10 hours depending on the location and the deposition rate at that location.

The deposit monitoring devices or probes illustrated in FIGS. 2 to 4, therefore, effect a number of measurements of the condition of the flue gas stream which enables improved deposit control at critical locations in the boiler to be achieved. Signals corresponding to the deposit accumulation rate and flue gas temperature at the locations of the probes in the flue gas stream are generated continuously and may be transmitted to the boiler room for display on the control panel for utilization by the operator, or may be used in an automatic or semi-automatic boiler control operation.

The improved deposit control which is achieved in accordance with the present invention has a significant economic impact on the boiler operation, in terms of sootblower steam requirements, mill shutdown and recovery boiler capacity.

Sootblower steam requirements are decreased by the use of the probes. Sootblowers typically consume about 10,000 kg/hr or about 6% of the total steam production of an average-sized recovery unit. A twenty percent decrease in this requirement represents a saving of about $200,000 per year. Fewer forced shutdowns of boiler for wash-out of plugging deposits also result from the use of the probes. Forced shutdowns of the recovery boiler are very costly since an average of two days lost production of pulp usually results. For a 750 ton per day kraft mill, lost revenue is about $300,000 per shutdown.

In many mills where there is a single production line, the recovery unit is the bottleneck to production. Incremental capacity is increasingly important as the cost of new capacity has dramatically increased and wood supplies dictate incremental mill expansion rather than new site development. The most important reason for unit capacity limits is flue gas passage plugging. Increased liquor load fired in the recovery unit increases deposit formation and the increased flue gas temperature resulting from the increased liquor load often leads to rapidly accelerated plugging. By the ability to monitor conditions closely using the probes of FIGS. 2 to 4, an increased load can be tolerated. A five percent increase in capacity for a 750 ton per day kraft mill represents an increased revenue of about $2,600,000.

In some cases, the recovery unit heat transfer surfaces are insufficient to extract the desired amount of heat from the flue gas sending hotter gas than necessary up the stack. Monitoring the flue gas conditions using the probe of the invention enables firing conditions to be controlled more closely. A one percent increase in thermal efficiency would produce an additional $200,000 worth of steam per year for an average sized mill. In addition, the improved deposit control achieved in the invention makes it possible to decrease significantly the area of heat transfer surface required, making recovery units smaller and cheaper.

There are about 770 kraft recovery units in the world with more than half located in North America. In Canada, there are about 75 recovery units in 51 kraft mills. If 20% of the mills in Canada adopted the principles of the invention, the savings would be $2,000,000 per year in steam, increased revenue of $3,000,000 per year due to fewer forced shutdowns, and increased revenue of $27,000,000 due to incremental pulp production capacity. The present invention, therefore, has considerable economic significance for the pulp industry.

The principles described in detail above with respect to pulp mill recovery units also are applicable to utility and industrial boilers, including coal and oil-fired boilers, and municipal and industrial wastage incinerators, and any other unit in which ash deposits foul the fireside of heat transfer surfaces and inhibit efficient operation thereof, although plugging problems usually are not the major concern they are in pulp mill recovery units.

EXAMPLE

A deposit measuring device of the type illustrated in FIG. 3 was used to generate signals from a flue gas stream in a kraft pulp mill recovery boiler. The probe tube was constructed of stainless steel, had a length of 2.5 m (100 inches) of which about 1.5 was exposed to the flue gas stream, and an outside diameter of 50 mm (2 inches). Two chromel-alumel thermocouples were embedded in the metal on the windward and leeward sides of the probe.

Figure 5:
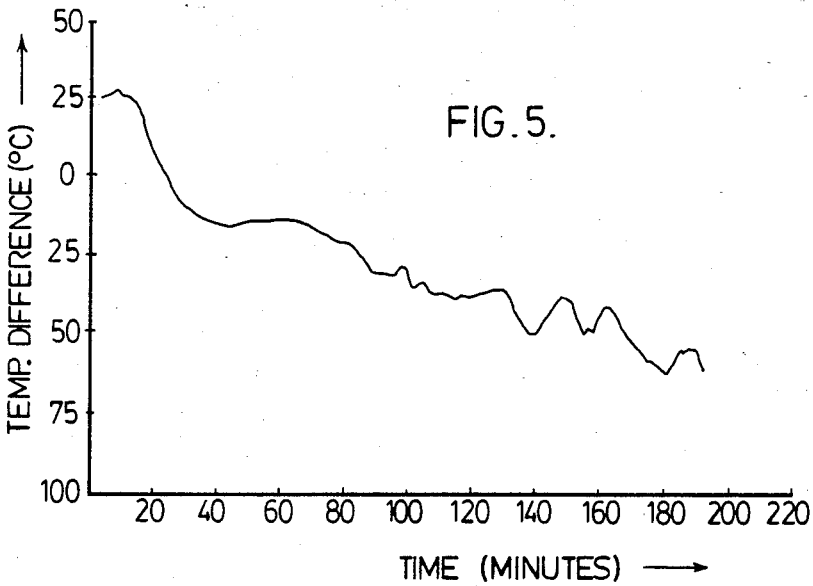
FIG. 5 is a graphical representation of the results of a kraft pulp mill trial conducted using the device of FIG. 3.

As the probe was inserted slowly into the furnace through a hole in the furnace cavity by a retracting device, the windward and leeward metal temperatures increased rapidly and became stable in about 5 minutes. The temperature difference ($\Delta T$) between the windward and leeward sides of the probe were determined during a 3-hour run in the superheater region. The value of $\Delta T$ decreased with time as the deposit accumulated. The results were plotted graphically and are reproduced in FIG. 5.

The probe was examined after the three-hour run. The leeward side deposits were white and thin while those on the windward side were pink and much thicker, about 17 mm.

SUMMARY

In summary of this disclosure, the present invention relates to improvements in boiler operations, especially kraft mill recovery boiler operation, which lead to significant benefits. Modifications are possible within the scope of the invention.

What we claim is:

1. A deposit monitoring device for contact with a hot flowing gas stream, which comprises elongate probe arm means adapted to be located in contact with the gas stream to establish a windward and a leeward side of said probe arm means with respect to said flowing gas stream, first heat detection means associated with said windward side of the probe arm means for detection of heat reaching said windward side of said probe arm means from said gas stream, and second heat detection means associated with said leeward side of the probe arm means for detection of heat reaching said leeward side of said probe arm means from said gas stream.

2. The measuring device of claim 1 wherein said probe arm means is a hollow tubular rod, is constructed of rigid, heat-conducting material and defining an internal surface, and said first and second heat detection means are located in contact with the internal surface of said probe arm means.

3. The measuring device of claim 2, wherein said probe arm means has a gaseous inlet at one longitudinal end and a gaseous outlet at the other longitudinal end and means for passing cooling air through said hollow probe arm means from said gaseous inlet to said gaseous outlet.

4. The measuring device of claim 2 wherein said first and second heat detection means comprise thermocouple means.

5. The measuring device of claim 1 including means associated with said probe arm means for periodically cleaning said windward side free from deposits formed thereon during contact with said flowing gas stream.

6. The measuring device of claim 1 including means for reciprocating said probe arm means into and out of contact with said gas stream and means for cleaning said probe arm means free from solid deposits thereon during periodic retraction of said probe arm means by said reciprocation means.

7. The measuring device of claim 6 wherein said cleaning means comprises a chamber through which the probe arm means is drawn and hot water spray jets for impinging hot water sprays onto the probe arm means.

8. The measuring device of claim 1, including comparator means for comparing the heat detected by said first heat detection means with the heat detected by said second heat detection means and for determining the build-up of deposits on said windward side of said probe arm means during contact with said gas stream from said comparison.

9. The measuring device of claim 1 including third heat detector means for detection of heat directly from the gas stream, first comparator means for comparing the heat detected by said third heat detection means with the heat detected by said first detection means and for determining the build-up of deposits on said windward side of said probe arm means during contact with said gas stream from said comparison, and second comparator means for comparing the heat detected by said third heat detection means with the heat detected by said second heat detection means and for determining the build-up of deposits on said leeward side of said probe arm means during contact with said gas stream from said comparison.

10. The measuring device of claim 9 wherein said probe arm means is hollow thereby defining an internal surface, said first and second heat detection means are located in contact with the internal surface of said probe arm means, said probe arm means has a gaseous inlet at one longitudinal end and a gaseous outlet at the other longitudinal end intended to exit into said gas stream, said third heat detection means being located at said gaseous outlet to be exposed to said gas stream, and means for passing air through said hollow probe arm means from said gaseous inlet to said gaseous outlet to inhibit the build-up deposits on said third heat detection means.

11. The measuring device of claim 10 including fourth heat detection means located in said probe arm means to detect the heat received from said air passing through said hollow probe arm means, and means for adjusting the determinations of deposit build-up on said windward side and said leeward side of said probe arm means in response to changes in temperature of said air detected by said fourth heat sensing means.

12. The measuring device of claim 1 including means for determining the physical state of the deposits built-up on said probe arm means.

13. The measuring device of claim 12 wherein means for measuring the electrical conductivity of deposits built-up on said probe arm means is used to determine the physical state of deposits.

14. A control method for a combustion operation wherein combustible material is burned to form a hot product gas stream from which heat is recovered by heat exchanger surfaces, said product gas stream potentially containing products of combustion depositable on said heat exchanger surfaces, which comprises:

locating in said gaseous product stream adjacent said heat exchanger surfaces a deposit surface in the form of elongate probe arm means which extends into the gas stream generally transverse to the direction of flow of the gas stream, so that a windward side and a leeward side of the probe arm means are established, detecting the build-up of deposits on said deposit surface, and controlling the combustion conditions to control the build-up of deposits on the heat exchanger surfaces in response to the detected build-up of deposits on said deposit surface.

15. A control method for a combustion operation wherein a combustible material is burned to form a flowing hot product gas stream from which heat is recovered by heat exchanger surfaces, said product gas stream potentially containing products of combustion depositable on said heat exchanger surfaces, which comprises:

locating in said gaseous product stream adjacent said heat exchanger surfaces a deposit surface in the form of an elongate cylindrical probe arm which extends into the flowing gas stream generally transverse to the direction of flow of the stream, so that a windward side and a leeward side of the probe arm are established, detecting the heat reaching the windward side of the probe arm from the gas stream through deposits formed thereon, detecting the heat reaching the leeward side of the probe arm from the gas stream through any deposits formed thereon, comparing the heat detected at the windward side with the heat detected at the leeward side as a measure of the rate of build-up of deposits on said windward side, and controlling the combustion conditions to control the build up of deposits on the heat exchanger surfaces in response to the detected build up of deposits on said deposit surface.

16. A control method for a combustion operation wherein a combustible material is burned to form a flowing hot product gas stream from which heat is recovered by heat exchanger surfaces, said product gas stream potentially containing products of combustion depositable on said heat exchanger surfaces, which comprises:

locating in said gaseous product stream adjacent said heat exchanger surfaces deposit surface in the form of an elongate cylindrical probe arm which extends into the flowing gas stream generally transverse to the direction of flow of the gas stream, so that a windward side and a leeward side of the probe arm are established, detecting the heat reaching the windward side of the probe arm from the gas stream through deposits formed thereon, detecting the heat reaching the leeward side of the probe arm from the gas stream through deposits formed thereon, detecting the heat reaching the probe arm in the absence of deposits, comparing the heat detected at the windward side with that received in the absence of deposits as a measure of the rate of build-up of deposits on the windward side, comparing the heat detected on the leeward side with that received in the absence of deposits on the leeward side as a measure of the rate of build-up of deposits on the leeward side, and controlling the combustion conditions to control the build-up of deposits on the heat exchanger surfaces in response to the detected build-up of deposits on said deposit surface.

17. The method of claim 14 including periodically cleaning the deposit surface free from deposits.

18. The method of claim 14 including determining the electrical conductivity of deposits formed on the deposit surface as a measure of the physical form of the deposit, and utilizing the electrical conductivity determination in said control of combustion conditions.

19. The method of claim 14 wherein said combustion operation is a kraft pulp mill black liquor recovery operation.

20. The method of claim 14 wherein a plurality of banks of said heat exchanger surfaces is provided in said gas stream and deposit surfaces are provided adjacent more than one of said banks.

21. The method of claim 14 wherein said control of combustion conditions is effected automatically.

22. A method of determining the temperature of a flue gas stream from a combustion operation wherein combustible material is burned to form the flue gas stream, which comprises:

locating a surface in said flue gas stream so as to establish a windward side and a leeward side thereof, and measuring the temperature at the leeward side of said surface.

23. The method of claim 22 wherein said surface is in the form of an elongate cylindrical probe arm which extends into the flue gas stream generally transverse to the direction of flow of the flue gas stream.

24. The method of claim 23 wherein said temperature is measured by detecting the heat reaching the leeward side of said probe arm.

25. The method of claim 17 wherein said cleaning is effected by retracting said probe arm means from said contact with gas stream while simultaneously contacting said probe arm means with cleaning means.

26. The method of claim 25 wherein said cleaning means comprises a chamber through which said probe arm means is drawn during retraction from contact with the gas stream and hot water sprays are impinged on the probe arm means in the chamber to remove deposits from the exterior of the probe arm means.

27. The method of claim 14 wherein said combustion operation is a kraft pulp mill black liquor recovery operation, and the control of combustion conditions is effected automatically.

28. The method of claim 27 wherein a plurality of banks of said heat exchanger surfaces is provided in said gas stream and deposit surfaces are provided adjacent more than one of said banks.

* * * * *